US007207373B2

(12) United States Patent
Parkos, Jr. et al.

(10) Patent No.: US 7,207,373 B2
(45) Date of Patent: Apr. 24, 2007

(54) NON-OXIDIZABLE COATING

(75) Inventors: Joseph J. Parkos, Jr., East Haddam, CT (US); Gary M. Lomasney, Glastonbury, CT (US); Joshua E. Persky, Carbondale, CO (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/973,132

(22) Filed: Oct. 26, 2004

(65) Prior Publication Data

US 2006/0086479 A1 Apr. 27, 2006

(51) Int. Cl.
*B22C 9/10* (2006.01)

(52) U.S. Cl. ..... 164/369; 164/370; 164/24; 164/28

(58) Field of Classification Search ..... 164/369, 164/370, 302, 24, 28, 30, 31, 32, 228
See application file for complete search history.

(56) References Cited

U.S. PATENT DOCUMENTS 2,682,101 A * 6/1954 Whitfield et al. ..... 428/651
3,634,208 A 1/1972 Kuroda
4,894,127 A * 1/1990 Wong et al. ..... 205/203
4,911,795 A 3/1990 Olliff, Jr.
4,931,421 A 6/1990 Shibata
5,104,514 A 4/1992 Quartarone
5,616,229 A 4/1997 Samsonov et al.
6,197,178 B1 3/2001 Patel et al.
6,365,028 B1 4/2002 Shatrov
6,637,500 B2 10/2003 Shah et al.
6,668,906 B2 * 12/2003 Burd ..... 164/302
6,670,050 B2 12/2003 Raybould et al.
6,884,460 B2 4/2005 Ackerman et al.
2001/0026840 A1 10/2001 Ozmat et al.
2001/0046605 A1 11/2001 Huni et al.

OTHER PUBLICATIONS

European Search Report for EP Patent Application No. 05255424.3

* cited by examiner

*Primary Examiner*—Kevin Kerns
*Assistant Examiner*—I.-H. Lin
(74) *Attorney, Agent, or Firm*—Bachman & LaPointe, P.C.

(57) ABSTRACT

A substrate is coated by applying an essentially pure aluminum first layer to a surface of the substrate. At least a first portion of the first layer is oxidized so as to provide a protective coating of desired properties. The substrate may be a refractory metal-based investment casting core.

17 Claims, 2 Drawing Sheets

NON-OXIDIZABLE COATING

BACKGROUND OF THE INVENTION

The invention relates to metallic coating. More particularly, the invention relates to protective coating of oxidizable investment casting cores.

Investment casting is a commonly used technique for forming metallic components having complex geometries, especially hollow components, and is used in the fabrication of superalloy gas turbine engine components.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

The ceramic cores themselves may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses general use of refractory metal cores in investment casting among other things. Various refractory metals, however, tend to oxidize at higher temperatures, e.g., in the vicinity of the temperatures used to fire the shell and the temperatures of the molten superalloys. Thus, the shell firing may substantially degrade the refractory metal cores and, thereby produce potentially unsatisfactory part internal features. Use of protective coatings on refractory metal core substrates may be necessary to protect the substrates from oxidation at high temperatures. An exemplary coating involves first applying a layer of chromium to the substrate and then applying a layer of aluminum oxide to the chromium layer (e.g., by chemical vapor deposition (CVD) techniques). However, particular environmental/toxicity concerns attend the use of chromium. Accordingly, there remains room for further improvement in such coatings and their application techniques.

SUMMARY OF THE INVENTION

One aspect of the invention involves an investment casting core having a refractory metal-based substrate and an essentially chromium-free coating directly atop the substrate. The coating includes a first layer consisting principally of aluminum oxide. The first layer has a first thickness in excess of 2.0μ. Optionally, a base layer may be located atop the substrate and consist principally of non-oxidized aluminum. Optionally, a transition layer may be located between the first layer and the base layer.

In various implementations, the substrate may be molybdenum-based. The first layer may consist essentially of aluminum oxide and the first thickness may be a nominal (e.g., a median) first thickness. The first thickness may be at least 4.0μ. A combined thickness for the base layer and transition layer, if either or both are present, may be no more than the first thickness. The core may be a first core in combination with a ceramic second core and a hydrocarbon-based material in which the first core and the second core are at least partially embedded.

Another aspect of the invention involves a method for coating a substrate. An essentially pure aluminum initial layer is applied to a surface of the substrate. At least a first portion of the initial layer is oxidized so as to leave the first portion with an unoxidized aluminum content of no more than 10% of a total aluminum content and a thickness of at least 2.0μ.

In various implementations, the applying may form the initial layer with a characteristic thickness of about 25μ–75μ. The applying may include at least one of ion vapor deposition, cold spray, and electrolytic deposition. The applying may consist essentially of ion vapor deposition. The oxidizing may include at least one of anodizing, hard coating, and micro-arc oxidation. The substrate may include at least one of a refractory metal-based material, an aluminum alloy, and a non-metallic composite. The substrate may consist essentially of a molybdenum-based material. The oxidizing may oxidize a majority of the aluminum in the applied initial layer. The method may be used to form an investment casting core component.

The method may further include assembling the core with a second core. A sacrificial material may be molded to the core and second core. A shell may be applied to the sacrificial material. The sacrificial material may be essentially removed. The metallic material may be cast at least partially in place of the sacrificial material. The core, second core, and shell may be destructively removed. Alternatively, the second core may be formed at least partially over the core.

Another aspect of the invention involves an article having a substrate having an essentially chromium-free surface. An essentially chromium-free coating is located directly atop the surface. The coating includes a first layer consisting essentially of aluminum oxide. The first layer has a first thickness in excess of about 2.0μ. Optionally, a base layer may be located directly atop the surface and consist essentially of non-oxidized aluminum. Optionally, a transition layer may be located between the first layer and the base layer.

In various implementations, the substrate may be molybdenum-based. The first layer may the first layer may have a density of at least 3.4 g/cc and a principally α-phase microstructure. The first layer may have a density of 3.6–4.0 g/cc and an essentially α-phase microstructure.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
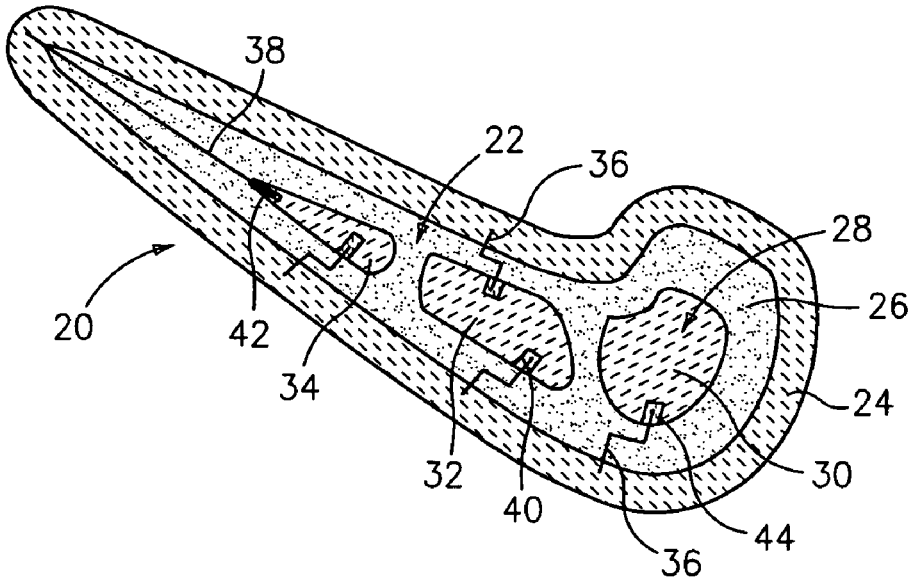
FIG. 1 is a cross-sectional view of a shelled investment casting pattern for forming a gas turbine engine airfoil element.

FIG. 1 shows a shelled investment casting pattern 20 including a pattern 22 and a ceramic shell 24. The pattern 22 includes a sacrificial wax-like material 26 (e.g., natural or synthetic wax or other hydrocarbon-based material) at least partially molded over a core assembly. The core assembly includes a ceramic feed core 28 having a series of generally parallel legs 30, 32, and 34 for forming a series of generally parallel, spanwise-extending, feed passageways in the ultimate part being cast (e.g., a gas turbine engine turbine blade, or vane). Assembled to the feed core 28 are a series of refractory metal cores (RMCs) 36 and 38. Portions of the RMCs 36 and 38 may be received in compartments 40 and 42 in the feed core 28 and secured therein via ceramic adhesive 44. Other portions of the RMCs 36 and 38 may be embedded in the shell 24 so that the RMCs 36 and 38 ultimately form outlet passageways from the feed passageways to the exterior surface of the part. The exemplary RMCs 36 provide film cooling passageways for airfoil pressure and suction side surfaces and the exemplary RMC 38 provides airfoil trailing edge cooling. Many other configurations are possible either in the prior art or yet to be developed.

Figure 2:
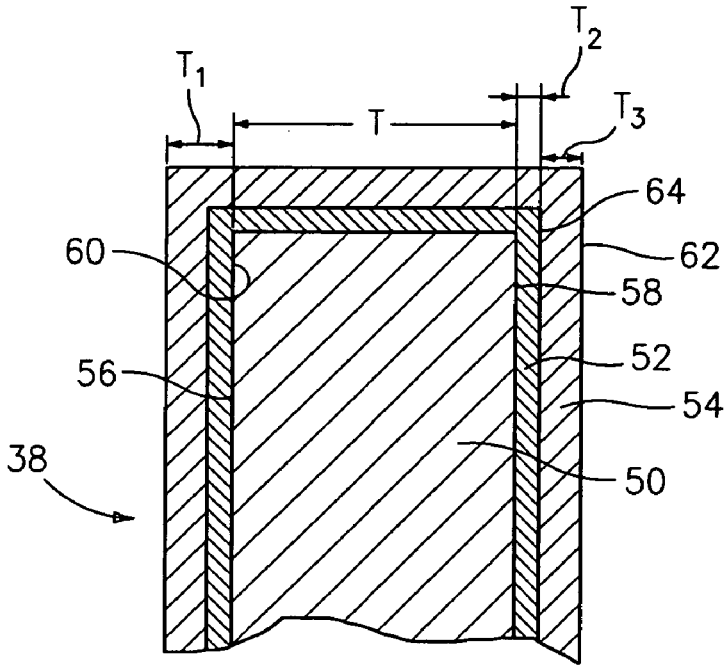
FIG. 2 is a sectional view of a refractory metal core of the pattern of FIG. 1.

FIG. 2 shows further details of one of the RMCs (e.g., 38). The exemplary RMC 38 has a substrate 50 of refractory metal or a refractory metal-based alloy, intermetallic, or other material. Exemplary refractory metals are Mo, Nb, Ta, and W. These may be obtained as wire or sheet stock and cut and shaped as appropriate. A coating system includes an aluminum first layer 52 atop the substrate and an aluminum oxide (alumina) second layer 54 atop the first layer 52. It is believed that $\alpha$-phase alumina offers advantageous hardness and adhesion/retention over a broad temperature range. Nevertheless other phases (e.g., material comprising or consisting essentially of one or both of $\beta$- and $\gamma$-phase) may be used. Exemplary alumina density is 3.4–4.0 g/cc The exemplary substrate 50 is formed, e.g., from sheet stock having a surface including a pair of opposed faces 56 and 58 with a thickness T between. Complex cooling features may be stamped, cut, or otherwise provided in the substrate 50. An interior surface 60 of the coating system and first layer 52 sits atop the exterior surface of the substrate 50 and an exterior surface 62 of the coating system and second layer 54 provides an exterior surface of the RMC 38. A transition 64 separates the first layer 52 from the second layer 54. The transition 64 may be fairly abrupt or may be a transition region characterized by a compositional median or compositional gradation. In the exemplary embodiment, the coating system has a thickness $T_1$, the first layer 52 has a thickness $T_2$, and the second layer 54 has a thickness $T_3$.

Figure 3:
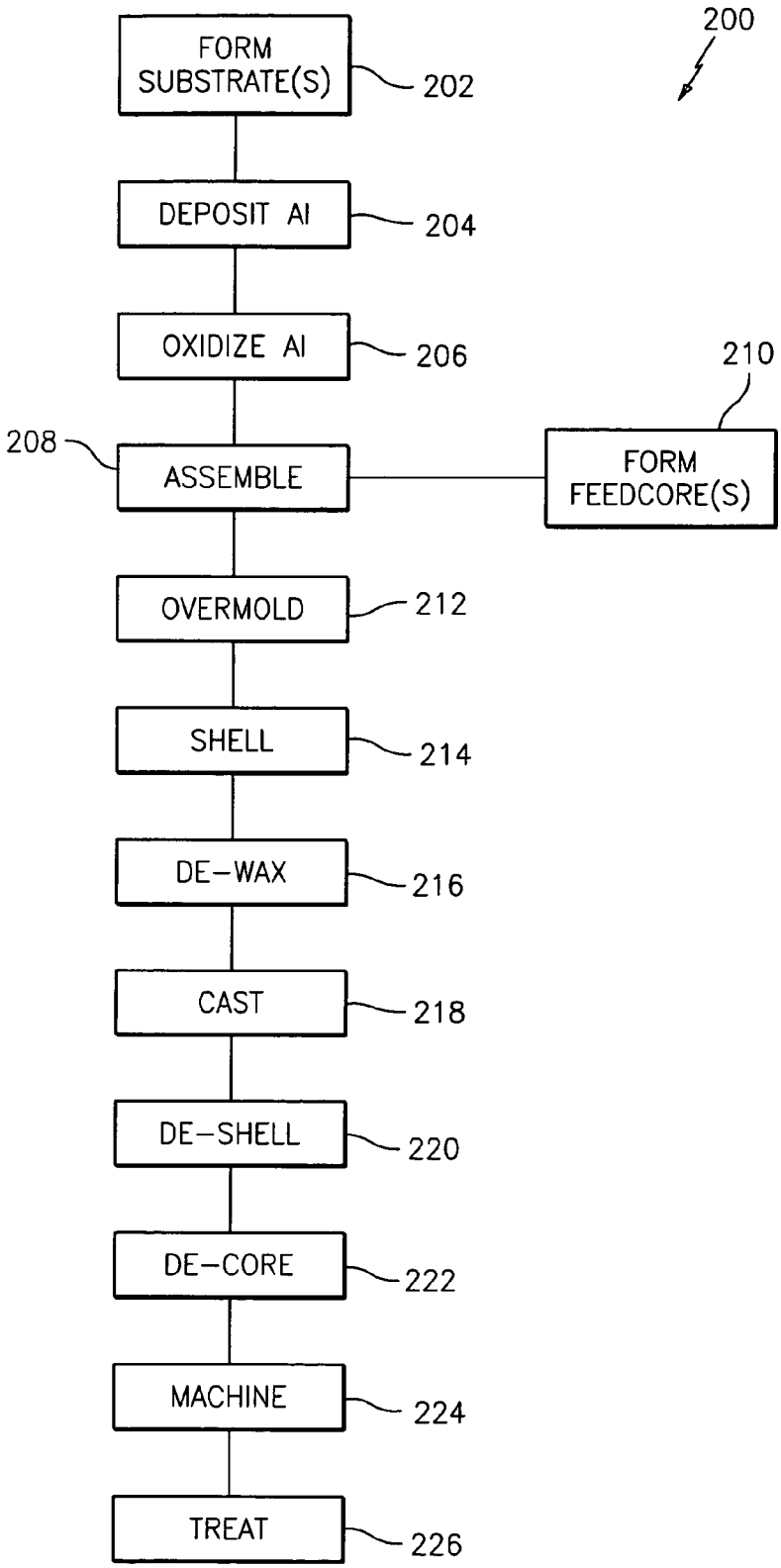
FIG. 3 is a flowchart of processes for forming and using the pattern of FIG. 1.

FIG. 3 shows an exemplary process 200 of manufacture and use (simplified for illustration). The substrate(s) are formed 202 such as via stamping from sheet stock followed by subsequent bending or other forming to provide a relatively convoluted shape for casting the desired features. An essentially pure aluminum coating is deposited 204 atop the substrate. The deposition process may be a physical or chemical deposition process. Exemplary physical deposition processes are ion vapor deposition (IVD) and cold spray deposition. Exemplary IVD and cold spray deposition techniques are shown in U.S. Military Standard Mil-C-83488 (for pure Al) and U.S. Pat. No. 5,302,414 of Alkhimov et al., respectively. Exemplary chemical processes include electrolytic plating. The deposited aluminum layer is then at least partially oxidized 206 to form the second layer 54 and leave the first layer 52. Exemplary oxidation is via chemical process such as anodizing, hard coating (a family of high voltage anodizing processes), and micro-arc oxidation. Exemplary micro-arc processes are shown in U.S. Pat. Nos. 6,365,028, 6,197,178, and 5,616,229.

The RMCs are then assembled to the feed core(s) which may be formed separately 210 (e.g., by molding from silicon-based material) or formed as part of the assembling (e.g., by molding the feed core partially over the RMCs). The assembling may also occur in the assembling of a die for overmolding 212 the core assembly with the wax-like material 26. The overmolding 212 forms a pattern which is then shelled 214 (e.g., via a multi-stage stuccoing process forming a silica-based shell). The wax-like material 26 is removed 216 (e.g., via steam autoclave). After any additional mold preparation (e.g., trimming, firing, assembling), a casting process 218 introduces one or more molten metals and allows such metals to solidify. The shell is then removed 220 (e.g., via mechanical means). The core assembly is then removed 222 (e.g., via chemical means). The as-cast casting may then be machined 224 and subject to further treatment 226 (e.g., mechanical treatments, heat treatments, chemical treatments, and coating treatments).

The coating process may provide an initial aluminum thickness in the range of 0.25–5 mil (6–130μ), more preferably. 1–3 mil (25–75μ). Some of this material is then oxidized to form the second layer 54. During the oxidation, some of the aluminum may be lost (e.g., into the anodizing bath). Advantageously, little if any of the aluminum diffuses into the substrate at least until firing/casting. At those elevated temperatures, some or all of the theretofore unoxidized aluminum may diffuse into/with the substrate material. The oxidation may advantageously form the second layer with the thickness $T_3$ in the vicinity of 5μ or more to provide adequate insulation. More broadly, the thickness may be in excess of 2μ (e.g., 4μ–50μ, or 20–40μ). Advantageously, at least 90% of the aluminum in the second layer 54 may be oxidized. The oxidation tends to expand the thickness of the second layer by 100% relative to the thickness of the deposited aluminum being oxidized. Thus, in the absence of diffusion or loss, a 25μ deposited aluminum layer could, if oxidized across its thickness, produces an aluminum oxide layer of thickness in the vicinity of 50μ. With a 20% loss and oxidation across substantially half the depth, the remaining first layer thickness $T_2$ would be about 10μ and the aluminum oxide second layer thickness $T_3$ would be about 20μ. The foregoing numbers are merely exemplary.

Advantageously, however, at least with the exemplary molybdenum substrate and various annodization processes, the first layer thickness is at least about 2.0μ. That is the minimum thickness believed appropriate to isolate the substrate from the effects of the annodization. If the thickness $T_2$ becomes less, the molybdenum may begin to dissolve, destroying the coating adherence. There is no inherent upper limit to the thickness $T_2$. However, excess thickness poses cost issues and represents a loss of insulation contrasted with the situation where such excess material is converted to alumina. Thus, typically, the alumina thickness $T_3$ will be at least half the total coating thickness $T_1$.

The coating technique may have broader applicability. For example, the substrate may be of highly alloyed aluminum atop which the purer aluminum layer is deposited and then at least partially oxidized. Alternatively, the substrate may be a composite material.

Various dopants or alloying elements may be used. Ca, Mg, Si, and Zr, for example, form stable oxide systems CaO, MgO, $SiO_2$, $ZrO_2$. These elements or their combinations may be deposited in an alloy with the aluminum to be oxidized (e.g., in exemplary low quantities of less than 1% by weight to control grain growth and the morphology of the coating and influence properties such as CTE). Greater quantities of these elements (including even major portions of the as-applied coating—pre-oxidation) are possible.

The present system and methods may have one or more advantages over chromium-containing coatings. Notable is reduced toxicity. Chromium containing coatings are typically applied using solutions of hexvalent chromium, a particularly toxic ion. Furthermore, when the coated core is ultimately dissolved, some portion of the chromium will return to this toxic valency. The present coatings may have less than 0.2%, preferably less than 0.01% chromium by weight, and, most preferably, no detectable chromium. The present system and methods may have one or more advantages over single-step coating of a substrate (e.g., molybdenum) with aluminum oxide. The aluminum oxide layer may have higher density. A greater evenness may be obtainable by using aluminum deposition techniques that do not suffer from the same line-of-sight problems as various single-step aluminum oxide deposition techniques.

One or more embodiments of the present invention have been described. Nevertheless, it will be understood that various modifications may be made without departing from the spirit and scope of the invention. For example, the coatings may be utilized in the manufacture of cores of existing or yet-developed configuration. The details of any such configuration may influence the details of any particular implementation as may the details of the particular ceramic core and shell materials and casting material and conditions. Accordingly, other embodiments are within the scope of the following claims.

What is claimed is:

1. An investment casting core comprising:
a refractory metal-based substrate; and
an essentially chromium-free coating directly atop the substrate, the coating comprising:
a first layer consisting principally of aluminum oxide, the first layer having a first thickness in excess of 2.0μ;
optionally a base layer atop the substrate and consisting principally of non-oxidized aluminum; and
optionally a transition layer between the first layer and the base layer.

2. The core of claim 1 wherein:
the substrate is molybdenum-based.

3. The core of claim 1 wherein:
the first layer consists essentially of aluminum oxide and the first thickness is a nominal first thickness.

4. The core of claim 1 wherein:
the first thickness is at least 4.0μ; and
a combined thickness of the base layer and transition layer, if either or both are present, is no more than said first thickness.

5. The core of claim 1 being a first core in combination with:
a ceramic second core; and
a hydrocarbon-based material in which the first core and the second core are at least partially embedded.

6. A plurality of cores of claim 1 in combination with:
a natural or synthetic wax material in which the plurality of cores are at least partially embedded.

7. An investment casting core comprising:
a refractory metal-based substrate; and
an essentially chromium-free coating located directly atop the substrate, the coating comprising:
a first layer consisting principally of a material in an essentially oxidized condition, the first layer having a first thickness in excess of 2.0μ;
a base layer atop the substrate and consisting principally of said material in an essentially non-oxidized condition; and
optionally a transition layer between the first layer and the base layer.

8. The core of claim 7 wherein:
the substrate is molybdenum-based.

9. The core of claim 7 wherein:
the material comprises an aluminum alloy.

10. The core of claim 9 wherein:
the aluminum alloy comprises 0.25%–1.0 weight percent of one or a combination of Ca, Mg, Si, and Zr.

11. The core of claim 9 wherein:
the aluminum alloy comprises 0.25%–1.0 weight percent of Mg.

12. The core of claim 7 wherein:
the first layer comprises principally α-phase.

13. The core of claim 7 wherein:
the material comprises an aluminum-silica alloy.

14. The core of claim 7 wherein:
the first thickness is at least 4.0μ; and
the base layer has a second thickness in excess of 2.0μ.

15. The core of claim 7 being a first core in combination with:
a ceramic second core; and
a hydrocarbon-based material in which the first core and the second core are at least partially embedded.

16. A method for forming an investment casting core comprising:
applying an initial layer of a first material to a surface of a substrate of a second material different from the first material; and
oxidizing at least a first portion of the initial layer so as to leave a principally oxidized sublayer of at least 5.0μ and an essentially intact sublayer of the first material of at least 2.0μ.

17. The method of claim 16 wherein the initial layer comprises, in major weight part, one or more of: Al; Ca; Mg; Si; and Zr.

* * * * *